US011295703B2

(12) United States Patent
Li et al.

(10) Patent No.: US 11,295,703 B2
(45) Date of Patent: Apr. 5, 2022

(54) DISPLAYS WITH CONTENT-DEPENDENT BRIGHTNESS ADJUSTMENT

(71) Applicant: Apple Inc., Cupertino, CA (US)

(72) Inventors: Yang Li, San Jose, CA (US); Yingying Tang, Mountain View, CA (US); Chaohao Wang, Sunnyvale, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 9 days.

(21) Appl. No.: 16/926,545

(22) Filed: Jul. 10, 2020

(65) Prior Publication Data

US 2021/0020140 A1 Jan. 21, 2021

Related U.S. Application Data

(60) Provisional application No. 62/875,221, filed on Jul. 17, 2019.

(51) Int. Cl.
*G09G 5/10* (2006.01)

(52) U.S. Cl.
CPC ..... *G09G 5/10* (2013.01); *G09G 2320/0626* (2013.01); *G09G 2360/144* (2013.01); *G09G 2360/16* (2013.01)

(58) Field of Classification Search
CPC ..... G09G 2320/0626; G09G 2360/144; G09G 2360/16; G09G 2330/021
See application file for complete search history.

(56) References Cited

U.S. PATENT DOCUMENTS

| | | | | |
|---|---|---|---|---|
| 8,576,157 | B2 | 11/2013 | Bae | |
| 10,417,995 | B2 | 9/2019 | Xu et al. | |
| 2014/0049567 | A1* | 2/2014 | Chen | H04N 13/106 345/690 |
| 2017/0034520 | A1* | 2/2017 | Rosewarne | G06T 5/009 |
| 2017/0186404 | A1 | 6/2017 | Hajjar et al. | |
| 2017/0353689 | A1* | 12/2017 | Choe | H04N 5/58 |
| 2018/0330674 | A1 | 11/2018 | Baar et al. | |
| 2018/0330695 | A1* | 11/2018 | Baar | G06K 9/6202 |
| 2020/0126509 | A1* | 4/2020 | Nasiopoulos | H04N 19/142 |

* cited by examiner

*Primary Examiner* — Priyank J Shah
(74) *Attorney, Agent, or Firm* — Treyz Law Group, P.C.; Kendall P. Woodruff

(57) ABSTRACT

An electronic device may be provided with an ambient light sensor, a display that displays image content, and control circuitry. The control circuitry may adjust a peak allowable brightness of the display based on an ambient light brightness and based on the image content being displayed. For example, the control circuitry may analyze frames of display data to determine an average pixel luminance level. Low average pixel luminance levels correspond to mostly dark image content, whereas high average pixel luminance levels correspond to mostly light image content. When an electronic device is outdoors and displaying mostly dark images with low average pixel luminance levels, the control circuitry may take advantage of the display's maximum achievable brightness to improve readability. When an electronic device is outdoors and displaying mostly light images with high average pixel luminance levels, the control circuitry may scale the maximum allowable brightness down to reduce power consumption.

19 Claims, 4 Drawing Sheets

DISPLAYS WITH CONTENT-DEPENDENT BRIGHTNESS ADJUSTMENT

This application claims the benefit of U.S. provisional patent application No. 62/875,221, filed Jul. 17, 2019, which is hereby incorporated by reference herein in its entirety.

BACKGROUND

This relates generally to electronic devices, and, more particularly, to electronic devices with displays.

Electronic devices often include displays. If care is not taken, displays may be damaged by displaying bright content for prolonged periods of time, displays may be operated with brightness levels that consume excessive power, user preferences may not be taken into account when adjusting display brightness, and displayed content may exhibit visible artifacts. Addressing these concerns while displaying content with a pleasing appearance is challenging.

SUMMARY

An electronic device may be provided with a display. A content generator on the electronic device may provide content to be displayed on the display.

Control circuitry in the electronic device may be used in implementing a tone mapping engine. The tone mapping engine may select a content-luminance-to-display luminance mapping to be used in displaying content on the display from the content generator. The content-luminance-to-display-luminance mapping may be characterized by tone mapping parameters such as a black level, a white level, and/or a peak brightness setting.

During operation, the tone mapping engine may adjust the tone mapping parameters based on ambient light levels and image content. For example, the control circuitry may analyze frames of display data to determine an average pixel luminance level, a median pixel brightness level, or other pixel brightness parameter associated with image content. Low average pixel luminance levels correspond to mostly dark image content, whereas high average pixel luminance levels correspond to mostly light image content.

When an electronic device is outdoors and displaying mostly dark images with low average pixel luminance levels, the control circuitry may take advantage of the display's maximum achievable brightness to improve readability. When an electronic device is outdoors and displaying mostly light images with high average pixel luminance levels, the control circuitry may scale the maximum allowable brightness down to reduce power consumption. The control circuitry may reduce the maximum allowable brightness of the display by multiplying a brightness scaling factor (e.g., ranging from 0 to 1) with the maximum achievable brightness of the display. The control circuitry may determine the brightness scaling factor based on the average pixel luminance levels. For example, a greater amount of white or light content in an image may use a lower brightness scaling factor (and thus a lower peak allowable brightness) to conserve power.

If desired, the control circuitry may only impose this type of content-dependent peak brightness adjustment when the user has enabled such a feature (e.g., when the user has enabled a dark viewing mode in which images are inverted or partially inverted so that the images are mostly dark content).

The control circuitry may apply a temporal low-pass filter so that the shifts between different peak brightness settings do not occur too rapidly.

DETAILED DESCRIPTION

Figure 1:
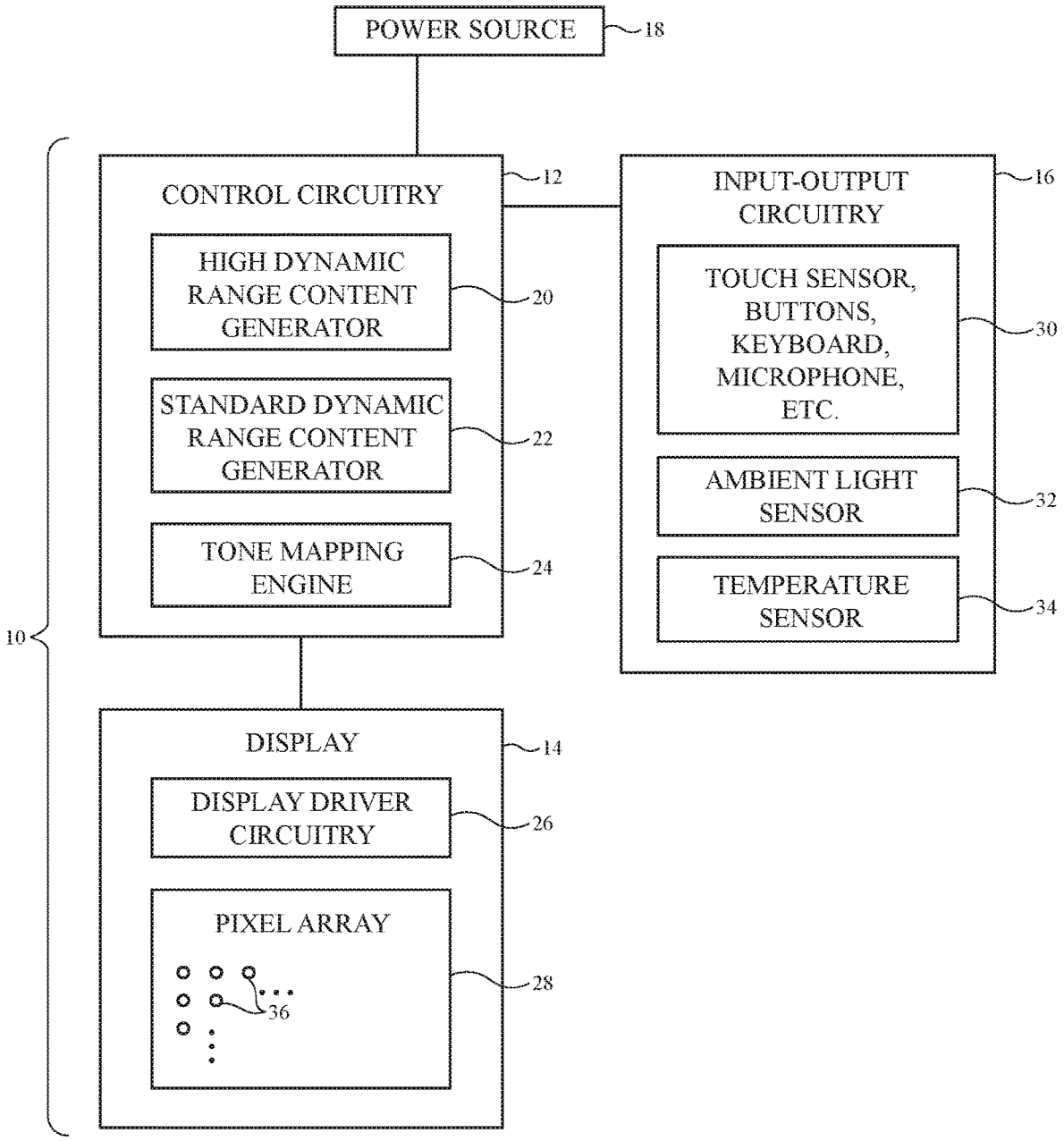
FIG. 1 is a schematic diagram of an illustrative electronic device having a display in accordance with an embodiment.

An illustrative electronic device of the type that may be provided with a display is shown in FIG. 1. As shown in FIG. 1, electronic device 10 may have control circuitry 12. Control circuitry 12 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application-specific integrated circuits, graphics processing units, display driver circuitry such as timing controller integrated circuits and other display driver integrated circuits, and other control circuitry.

Control circuitry 12 is configured to execute instructions for implementing desired control and communications features in device 10. For example, control circuitry 12 may be used in determining pixel luminance levels that are to be used in displaying content for a user. Pixel luminance levels may be based, for example, on ambient light conditions, user-adjusted display brightness settings, statistical information associated with content that is being displayed, and display characteristics. Control circuitry 12 may be configured to perform these operations using hardware (e.g., dedicated hardware such as integrated circuits and thin-film circuits) and/or software (e.g., code that runs on control circuitry 12). Software code for performing control and communications operations for device 10 may be stored on non-transitory computer readable storage media (e.g., tangible computer readable storage media). The software code may sometimes be referred to as software, data, program instructions, instructions, or code. The non-transitory computer readable storage media may include non-volatile memory such as non-volatile random-access memory (NVRAM), one or more hard drives (e.g., magnetic drives or solid state drives), one or more removable flash drives or other removable media, other computer readable media, or combinations of these computer readable media or other storage. Software stored on the non-transitory computer readable storage media may be executed on the processing circuitry of control circuitry 12 during operation of device 10.

Input-output circuitry 16 in device 10 may be used to allow data to be supplied to device 10 from a user or external equipment, may be used to gather environmental data, and may be used to supply data to external equipment and output for a user. Input-output circuitry 16 may include input-output devices 30 such as buttons, joysticks, scrolling wheels, touch pads, key pads, keyboards, microphones, speakers, tone generators, vibrators, cameras, sensors, light-emitting diodes and other status indicators, touch sensitive displays (e.g., touch sensors overlapping pixel arrays in displays), data ports, etc. As shown in FIG. 1, input-output circuitry 16 may include a color ambient light sensor or other ambient light sensor 32 for gathering ambient light measurements (e.g., ambient light levels such as ambient light luminance measurements and/or ambient light color measurements such as color temperature measurements and/or color coordinate measurements). Input-output circuitry 16 may also include temperature sensor circuitry such as one or more temperature sensors. Temperature sensors such as temperature sensor 34 may be used to gather real time information on the operating temperature of device 10 and display(s) associated with device 10.

Power may be supplied to control circuitry 12 and other resources in device 10 using one or more power sources such as power source 18. Power source 18 may be an alternating-current (AC) source such as a wall outlet (mains supply) and/or a direct-current (DC) source such as a battery. During operation, control circuitry 12 can detect whether power is being received from an AC or DC source and can monitor the charge state of the battery.

Device 10 may include one or more internal and/or one or more external displays such as illustrative display 14. Display 14 may be mounted in a common housing with device 10 (e.g., when device 10 is a mobile device such as a cellular telephone, wristwatch device, tablet computer, or laptop computer or when device 10 is an all-in-one device such as a television or desktop computer). In other configurations, display 14 may be coupled to device 10 wirelessly or with a cable (e.g., when device 10 is a desktop computer or a set-top box).

In general, device 10 may be any suitable type of device. Device 10 may, for example, be a computing device laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. Device 10 (e.g., a portable device) may be exposed to a variety of environmental conditions. For example, ambient light levels and therefore display glare may vary as a portable device is moved between indoors and outdoors environments (as an example).

Electronic device may have a housing. The housing, which may sometimes be referred to as an enclosure or case, may be formed of plastic, glass, ceramics, fiber composites, metal (e.g., stainless steel, aluminum, etc.), other suitable materials, or a combination of any two or more of these materials. The housing may be formed using a unibody configuration in which some or all of the housing is machined or molded as a single structure or may be formed using multiple structures (e.g., an internal frame structure, one or more structures that form exterior housing surfaces, etc.). In laptop computers and other foldable devices, a first portion of the housing may rotate relative to a second portion of the housing (e.g., a display housing in a laptop computer may rotated about a hinge axis relative to a base housing in the laptop computer).

Display 14 may be mounted in the housing. Display 14 may have a rectangular outline and be surrounded by four peripheral edges, may have a shape that is circular or oval, or may have other suitable outlines. Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may have an array 28 of pixels 36 for displaying images for a user (e.g., video, graphics, text, etc.). Display driver circuitry 26 (e.g., thin-film transistor circuitry on display 14 and/or one or more timing-controller integrated circuits and/or other display driver integrated circuits) may be used to display images on pixel array 28. Pixel array 28 may include, for example, hundreds or thousands of rows and hundreds or thousands of columns of pixels 36. To display color images, each pixel 36 may include subpixels of different colors. For example, each pixel 36 may include, red, green, and blue subpixels or subpixels of different colors. By varying the relative intensity of light emitted by each subpixel in a pixel, pixel output color can be adjusted. The color cast (white point) of each pixel can be adjusted by modifying the gain associated with each subpixel.

The pixel array of display 14 may be formed from liquid crystal display (LCD) components, an array of electrophoretic display pixels, an array of plasma display pixels, an array of organic light-emitting diode pixels or other light-emitting diodes, an array of electrowetting display pixels, or pixels based on other display technologies. Display 14 may be backlit with an array of locally dimmable light-emitting diodes or other suitable backlight structures. Display 14 may display images with a standard dynamic range (e.g., images that exhibit a contrast ratio of about 1,000:1 between their brightest and darkest pixel luminance values) and/or may display images with a high dynamic range (e.g., images that exhibit a contrast ratio of about 10,000:1 or more between their brightest and darkest luminance values).

During operation, content generators in device 10 (e.g., operating system functions and/or applications running on control circuitry 12) may generate content for display on the pixel array of display 14. As an example, electronic device 10 may include one or more standard dynamic range (SDR) content generators (e.g., games or other code rendering content, content players, etc.) and/or more high dynamic range (HDR) content generators (e.g., games or other code rendering content, content players, etc.). A luminance value mapping engine such as tone mapping engine 24 may be used to provide content generators with tone mapping parameters (sometimes referred to as luminance value mapping parameters) indicating how the content generators should map content luminance values to display luminance values and/or may be used to directly perform content-luminance-to-display-luminance mapping operations on content luminance values from the content generators. For example, tone mapping engine 24 may supply content generators with tone mapping parameters such as a black level, white level, and/or a peak brightness setting to use in producing display luminance values for use in displaying images with pixels 36. Tone mapping engine 24 may be implemented using code running on control circuitry 12 of FIG. 1, control circuitry for device 10 such as display driver circuitry 26, and/or other control circuitry and/or may use hardwired features of the control circuitry in device 10. The tone mapping parameters may be expressed in any suitable format (e.g., cd/m$^2$, nits, or other suitable unit).

Standard dynamic range content is often encoded in grey levels (e.g., 0-255 in an 8-bit display), where 0 corresponds to dark black and 255 corresponds to bright white. High dynamic range content is often encoded in luminance levels for each pixel (generally to be displayed for standard viewing conditions such as dim viewing conditions). Device 10 may experience changes in ambient lighting conditions, user brightness settings may be adjusted up and down by a user, the content being displayed on display 14 may exhibit changes such as changes in average pixel luminance, burn-in risk, image quality, and other conditions related to the presentation of content on display 10 may change over time. Device 10 may use tone mapping engine 24 to ensure that content is rendered appropriately for displaying on display 14 in view of these potentially changing conditions and other criteria such as the characteristics of display 14.

In some arrangements, tone mapping parameters produced by tone mapping engine 24 may include brightness parameters such as a peak brightness setting. The peak brightness setting of display 14 may refer to the maximum allowable brightness of any given pixel in display 14. The maximum allowable brightness of a pixel may refer to the brightness produced by that pixel when the pixel displays white. For example, in a 8-bit display with pixels that contain red, green, and blue subpixels, the maximum allowable brightness may refer to the brightness produced by that pixel when the red, green, and blue subpixels receive digital display control values of 255 (corresponding to the color white). In contrast, the maximum achievable brightness of a display 14 and/or a pixel in display 14 may refer to the maximum brightness that the display or pixel is physically capable of producing. The maximum allowable brightness of display 14 may, in some instances, be equal to the maximum achievable brightness of display 14. In other scenarios, the maximum allowable brightness of display 14 may be less than the maximum achievable brightness of display 14 (e.g., to conserve power in bright outdoor light when display 14 is displaying mostly light image content).

The peak brightness of display 14 (sometimes referred to as the maximum allowable brightness, the peak allowable brightness, the white level, or the peak brightness setting) may be expressed in any suitable format. In some arrangements, the peak brightness may be expressed as a peak brightness value (e.g., 6,500 nits, 1,200 nits, etc.).

In other arrangements, the peak brightness may be expressed as a factor of the maximum brightness of which display 14 is capable (i.e., the maximum achievable brightness of display 14). The peak brightness factor (sometimes referred to as a brightness scaling factor or peak brightness scaling factor) may range from 0 to 1 and may be multiplied by the maximum achievable brightness of display 14 to obtain the maximum allowable brightness level. Thus, in a display that can achieve 1,200 nit brightness levels, a peak brightness factor of 1 indicates that the maximum allowable brightness of display 14 is equal to 1,200 nits, whereas a peak brightness factor of 0.8 would result in a peak allowable brightness of 960 nits (0.8*1,200 nits=960 nits).

In outdoor environments, control circuitry 12 may increase display brightness in order to maintain good readability in bright ambient light. If care is not taken, however, sustaining high display brightness for long periods of time may lead to aging effects, excessive device temperatures, reduced battery life, increased burn-in risk, etc. Control circuitry 12 may use tone mapping engine 24 to produce brightness parameters that achieve good readability in bright ambient light without compromising the health of display 14 and/or device 10. For example, control circuitry 12 may use a brightness setting (e.g., a peak brightness setting) that is based on the content being displayed on display 14 (e.g., based on whether the content on display 14 is mostly light content or mostly dark content, based on whether the content on display 14 is mostly color content or mostly black and white content, based on the average pixel luminance levels associated with the content on display 14, based on median pixel luminance levels associated with the content on display 14, and/or based on other information associated with the content on display 14).

Figure 2:
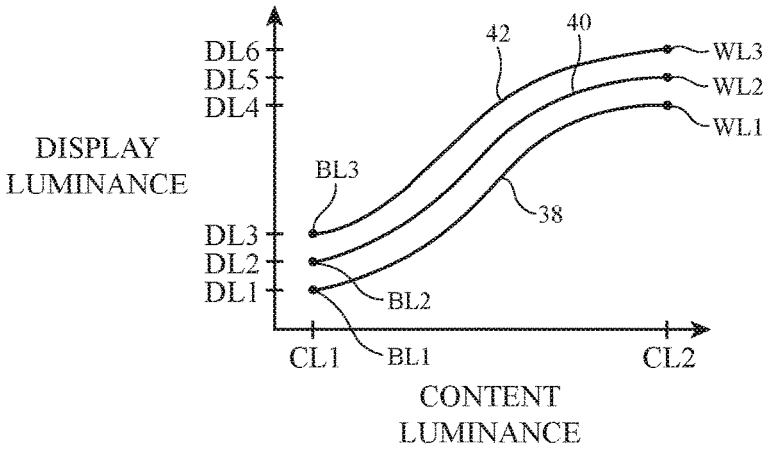
FIG. 2 is a graph showing how content luminance may be mapped to display luminance according to different peak brightness settings in accordance with an embodiment.

FIG. 2 is a graph showing how content luminance values can be mapped to display luminance values in device 10 in accordance with three illustrative content-luminance-to-display-luminance mapping curves (sometimes referred to as tone mapping curves). The content luminance and display luminance axes of the graph of FIG. 2 have logarithmic scales. In the FIG. 2 example, each content-luminance-to-display-luminance mapping curve is associated with a different peak brightness setting. When a low peak brightness setting is selected, display 14 displays content in accordance with curve 38. When a moderate peak brightness setting is selected, display 14 displays content in accordance with curve 40. When a high peak brightness setting is selected, display 14 displays content in accordance with curve 42.

In each of these curves, low content luminance values are associated with black and low grey levels, and high content luminance values are associated with white and high gray levels. At black content luminance level CL1, curve 38 is associated with a display pixel luminance value of DL1, curve 40 is associated with a display pixel luminance value of DL2, and curve 42 is associated with a display pixel luminance value DL3. The luminance level DL2 is brighter than luminance level DL1, because curve 40 is associated with a brighter set of output luminances from pixels 36 than curve 38. Similarly, luminance level DL3 is brighter than luminance level DL2 because curve 42 is associated with a brighter set of output luminances from pixels 36 than curve 40. At white content luminance level CL2, curve 38 is associated with a display pixel luminance value of DL4, curve 40 is associated with a display pixel luminance value of DL5, and curve 42 is associated with a display pixel luminance value DL6.

The example of FIG. 2 in which curves 38, 40, and 42 have different black levels for the same content luminance value CL1 and different white levels for the same content luminance value CL2 is merely illustrative. If desired, curves 38, 40, and 42 may have the same luminance level (e.g., black level) at content luminance value CL1 and different luminance levels (e.g., white levels) at content luminance value CL2, or curves 38, 40, and 42 may have different luminance levels at content luminance value CL1 and the same luminance level at content luminance value CL2.

Tone mapping curves may be identified using a set of tone mapping parameters such as a black level (BL) and a white level (WL). In the example of FIG. 2, curve 38 is associated with black level BL1 and white level WL1; curve 40 is associated with black level BL2 and white level WL2; and curve 42 is associated with black level BL3 and white level WL3. These examples are merely illustrative, however. As discussed above, curves 38, 40, and 42 may have the same black level (e.g., BL1) and different white levels (e.g., WL1, WL2, and WL3), if desired, or vice versa.

If desired, tone mapping curves such as curves 38, 40, and 42 may be identified using other tone mapping parameters such as a peak brightness setting. For example, curve 38 may be identified using a peak brightness setting equal to DL4, which indicates that the maximum allowable brightness of pixels 36 is DL4 (e.g., 80% of the maximum brightness of which pixels 36 are capable, as an example); curve 40 may be identified using a peak brightness setting equal to DL5 (e.g., 90% of the maximum brightness of which pixels 36 are capable, as an example); and curve 42 may be identified using a peak brightness setting equal to DL6 (e.g., 100% of the maximum brightness of which pixels 36 are capable, as an example). In general, any suitable parameter may be used to identify the appropriate tone mapping curve with which content should be displayed on display 14. Arrangements in which tone mapping parameters include a peak brightness setting may sometimes be described herein as an illustrative example.

During operation, engine 24 may supply content generators such as content generators 20 and/or 22 with suitable values of these tone mapping parameters, thereby informing content generators 20 and/or 22 whether to use curve 38, curve 40, or curve 42. If, for example, engine 24 supplies a content generator with tone mapping parameters BL1, WL1, and/or DL4, the content generator can generate display luminance values from content luminance values following curve 38. If engine 24 supplies the content generator with tone mapping parameters BL2, WL2, and/or DL5, the content generator can generate display luminance values from content luminance values following curve 40. The content generator can generate display luminance values from content luminance values following curve 42 in response to tone mapping parameters BL3, WL3, and/or DL6 from engine 24. In this way, a set of tone mapping parameters (e.g., three or more tone-mapping parameters, 3-10 tone-mapping parameters, fewer than 5 tone-mapping parameters, etc.) can be used by engine 24 to specify a desired tone mapping relationship for the content generator to follow depending on current operating conditions.

If desired, user studies, modeling, and laboratory testing may be used to help establish desired tone mapping schemes for device 10 under a variety of operating conditions (e.g., user brightness settings, ambient light levels, display content, and other operating conditions). These tone mapping schemes can then be implemented by tone mapping engine 24.

With one illustrative configuration, tone mapping engine 24 can select a desired tone mapping curve based on operating conditions such as display brightness settings (e.g., user-defined brightness settings and brightness levels set by device 10 to accommodate a normal power operating mode and a low-power operating mode), ambient conditions (ambient light level and ambient light color), image content information (e.g., information on average pixel luminance, information on median pixel luminance, information on amounts of color content, information on amounts of black and white content, information on which application is displaying content on display 14, burn-in risk information, and/or other information on operating conditions having a potential impact on display lifetime, quality information, dynamic range information etc.), display characteristics (e.g., display limitations such as maximum achievable pixel luminance), power constraints (e.g., battery life, whether device 10 is operating on AC power or DC power such as power from the battery in source 18 of device 10), thermal limitations, etc.

During operation, tone mapping engine 24 may obtain information on these operating conditions and may take suitable action to ensure that display 14 displays images satisfactorily. Tone mapping engine 24 may, as an example, remap content so that luminance values that are too high when output from a content generator are reduced by engine 24 before these values are used by display 14. Tone mapping engine 24 may also provide content generators such as content generators 20 and/or 22 with tone mapping parameters that inform the content generators of a desired content-luminance-to-display-luminance mapping curve to be used in displaying images on display 14.

Figure 3:
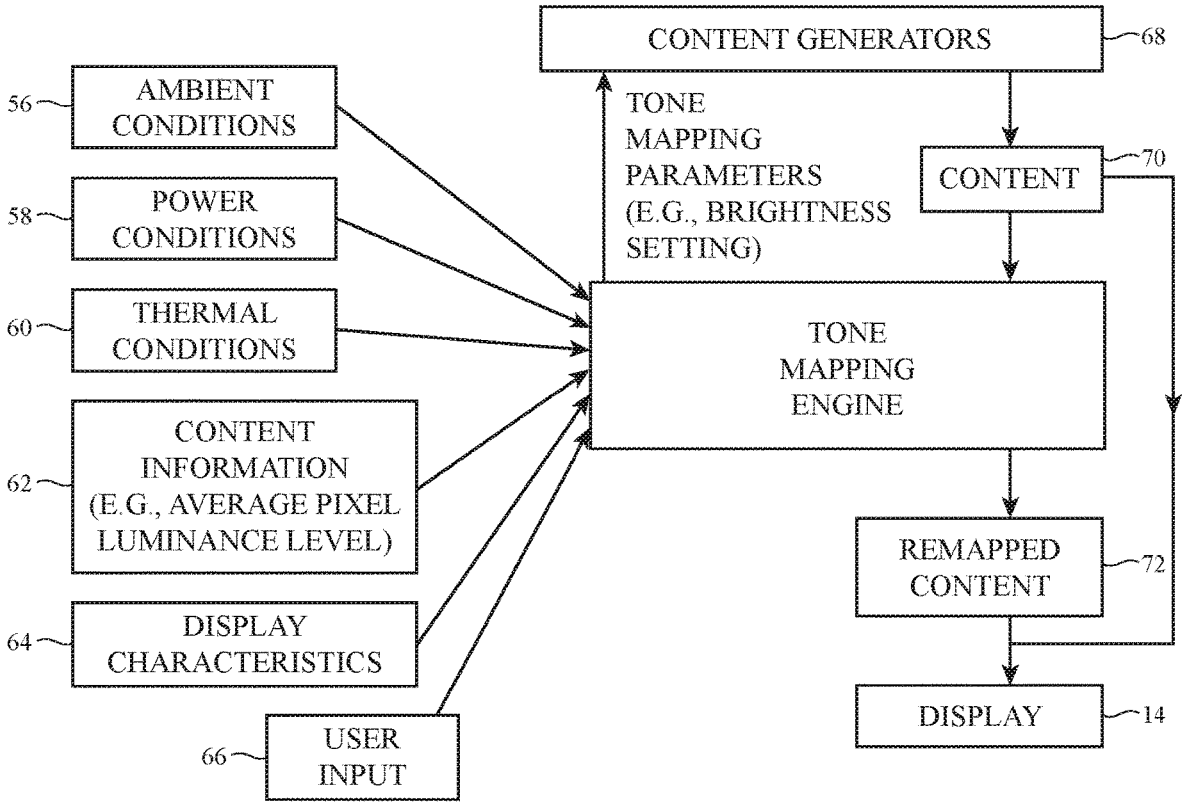
FIG. 3 is a diagram showing how a tone mapping engine may use ambient light information and image content information to determine tone mapping parameters such as a peak brightness setting in accordance with an embodiment.

FIG. 3 is a diagram showing how tone mapping engine 24 may receive input such as ambient conditions 56, power conditions 58, thermal conditions 60, content information 62, display characteristics 64, and user input 66.

Ambient conditions 56 may include a current ambient light level measured with ambient light sensor 32 and/or a current ambient color (e.g., a color temperature, set of color coordinates, etc.) measured with ambient light sensor 32. As environmental brightness increases, display brightness can be increased to compensate for screen glare. As environmental color shifts (e.g., as a user moves device 10 from a warm indoor lighting environment to a cold outdoor lighting environment), the white point (color cast) of display 14 can be adjusted accordingly (e.g., shifted from a warm white to a cool white) to avoid undesired color cast effects in displayed images.

Power conditions 58 may include power consumption considerations such as a current battery level, whether device 10 is operating in a normal power mode or a low power mode, and/or other information relating to the battery life and power consumption of device 10. Power-consumption-based brightness level adjustments may be made by control circuitry 12 to help extend battery life. For example, control circuitry 12 may lower the brightness level for display 14 based on a detection that a user has placed device 10 in a low power mode to extend battery life. In low power mode, control circuitry 12 may lower the current display brightness setting, may impose a cap on the brightness level, and/or may reduce the luminance of specular highlights or may make other adjustments that help reduce the power consumption of display.

Thermal conditions 60 may include information such as a temperature level of device 10 measured with sensor 34. Control circuitry 12 may lower the brightness level for display 14 in response to a detection that a temperature level measured with sensor 34 has exceeded a predetermined level.

Content information 62 may be gathered by analyzing frames of image data produced by content generator(s) 68

(e.g., content generators such as content generators 20 and 22 of FIG. 1) that are being displayed on display 14. Control circuitry 12 (e.g., a microprocessor, display driver integrated circuits, graphics processing unit circuitry, and/or other control circuitry in device 10) may, for example, maintain running averages of image luminance values (e.g., a running average pixel luminance value for images being displayed on display 14 over multiple image frames) and/or may maintain historical luminance information in a more granular fashion (e.g., on blocks of one or more pixels 36 within pixel array 28) to quantify burn-in risk for each of these blocks. Other content statistics such as information on content quality such as bit depth, dynamic range of image input data (e.g., minimum, mean, and maximum value), compression type and amount, data rate, noise level, metadata-specified quality factors, and other content quality metrics can also be gathered and provided to tone mapping engine 24.

Display characteristics 64 may also be used by tone mapping engine 24. Display characteristics 64 may include information on physical display limitations for display 14. For example, display characteristics 64 may include information on the characteristics of pixel array 28 and display 14 (e.g., maximum achievable brightness, display resolution, contrast ratio, bit depth, etc.). These display characteristics may be stored in control circuitry 12 during manufacturing (e.g., when display 14 is built into device 10) and/or may be obtained from display 14 when display 14 is coupled to device 10 (e.g., when display 14 is a stand-alone display). A user may also supply control circuitry 12 with display characteristics information (e.g., by entering this information using a keyboard or other input-output device). In some configurations, display characteristics may be set by default and/or retrieved from a database of display characteristics maintained in device 10 (e.g., a database of stand-alone display models).

User input 66 may include a user-selected brightness level, a user-selected power mode, a user-selected color scheme (e.g., whether the user prefers dark text on a light background or light text on a dark background), a user-selecting dark viewing mode (e.g., whether the user has enabled a feature that inverts some or all image content so that images on display 14 are mostly dark), and/or other user input or stored user preferences that affect the operation of display 14 or device 10. User input may be touch screen user input, keyboard user input, button user input, and/or other user input.

During operation, content generators 68 may produce content 70 to be displayed on display 14. Content generators 68 may, for example, render game images in a video game, may retrieve stored movie data and provide corresponding video frames to be displayed on display 14, may produce still image frames associated with an operating system function or application program, and/or may produce other content for displaying on display 14. The content from content generators 68 may include standard dynamic range content and/or high dynamic range content.

Tone mapping engine 24 may use information on ambient conditions 56, power conditions 58, thermal conditions 60, content information 62, display characteristics 64, and user input 66 to determine how original content values should be mapped to display content values (e.g., to determine how to map content luminance values to display luminance values in accordance with mapping curves of the type described in connection with FIG. 2). To ensure that content is displayed appropriately on display 14, tone mapping engine 24 can provide content generators 68 with tone mapping parameters such as a peak brightness setting to use in performing luminance mapping operations and/or can implement luminance mapping for content generators 68.

In some configurations, content generators 68 may be capable of adjusting content luminance values internally. In these situations, tone mapping engine 24 can supply content generators 68 with tone mapping parameters such as a black level, a white level, a peak brightness setting, and/or other tone mapping parameters. The tone mapping parameters inform content generators 68 of an appropriate mapping curve to use in supplying content 70 to display 14.

In other configurations, content generators 68 may not be capable of adjusting content luminance values internally or it may otherwise be desirable to implement tone mapping separately from the tone mapping functions of content generators 68. In these circumstances, content 70 from content generator 68 may be provided to tone-mapping engine 24. Tone mapping engine 24 may then apply a desired content-luminance-to-display luminance mapping (e.g., a mapping defined by the tone mapping parameters such as a black level, a white level, and/or a peak brightness setting) to ensure that the luminance of content 70 is adjusted appropriately (e.g., so that content 70 is remapped in accordance with a desired content-luminance-to-display luminance mapping to produce corresponding remapped content 72 for displaying on display 14). In mapping the luminance values of content 70 to the new (remapped) luminance values of content 72, the content-luminance-to-display luminance mapping that is used by engine 24 may follow pre-defined parameters (e.g., default) tone mapping parameters or may use the same tone mapping parameters that engine 24 would provide to a content generator that is capable of adjusting content luminance values by applying the desired mapping internally.

Figure 4:
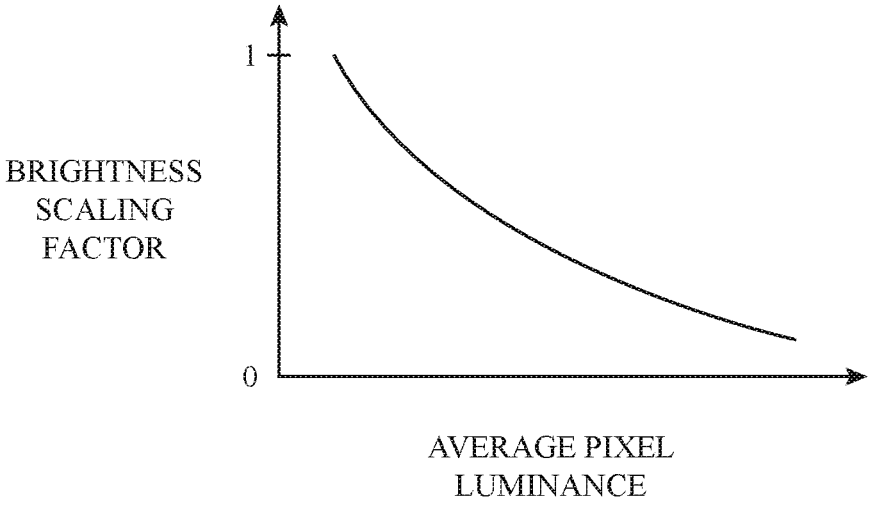
FIG. 4 is a graph showing how a brightness scaling factor may decrease as an average pixel luminance value increases in accordance with an embodiment.

FIG. 4 is a graph showing how tone mapping parameters such as a peak brightness setting may be adjusted dynamically by engine 24 based on image content information such as average pixel luminance level. If desired, the peak brightness setting of display 14 may be based on other pixel brightness parameters such as a median pixel luminance level (e.g., the median pixel luminance level associated with one or more frames of display data) and/or may be based on other information about the image content on display 14. Arrangements in which the peak brightness setting of display 14 is adjusted based on average pixel luminance levels are sometimes described herein as an example. In particular, control circuitry 12 may apply a brightness scaling factor to the maximum achievable brightness or default brightness of display 14 based on the average pixel luminance level associated with images to be displayed. Average pixel luminance levels may range from 0% to 100%, with one 100% corresponding to a full white image and 0% corresponding to a full black image.

FIG. 4 shows how tone mapping engine 24 may apply a brightness scaling factor of 1 when average pixel luminance values are low. When a brightness scaling factor of 1 is applied, the peak allowable brightness of display 14 may be equal to the peak brightness of which display 14 is capable (e.g., the maximum achievable brightness of display 14) and/or may be equal to some other default peak brightness level. When average pixel luminance values are high, control circuitry 12 may scale down the maximum allowable brightness of display 14 accordingly. For example, control circuitry 12 may apply a brightness scaling factor between 0 and 1 when average pixel luminance levels are high. When control circuitry 12 applies a brightness scaling factor of 0.8, for example, the maximum allowable brightness of display 14 may be equal to 0.8 multiplied by the maximum brightness of which display 14 is capable and/or a default maximum brightness level. Scaling down the peak brightness of display 14 when display 14 displays mostly white content (e.g., high average pixel luminance) may help reduce power consumption. On the other hand, maintaining a high peak brightness for images that are mostly dark content (e.g., low average pixel luminance) may help maintain good readability in outdoor environments.

Consider, as an example, a display with a maximum achievable brightness of 1,200 nits. When the brightness scaling factor is equal to 1, the maximum allowable brightness of display 14 may be set to 1,200 nits. As such, the brightness of pixels 36 may reach 1,200 nits when displaying the color white (e.g., R=G=B=255). A brightness scaling factor of 1 may, for example, correspond to tone mapping curve 42 of FIG. 2. When the brightness scaling factor is equal to 0.8, the maximum allowable brightness of display 14 may be set to 960 nits. With this brightness setting, the brightness of pixels 36 may only reach 960 nits when displaying the color white (e.g., R=G=B=255). A brightness scaling factor of 0.8 may, for example, correspond to tone mapping curve 38 of FIG. 2.

Figure 5:
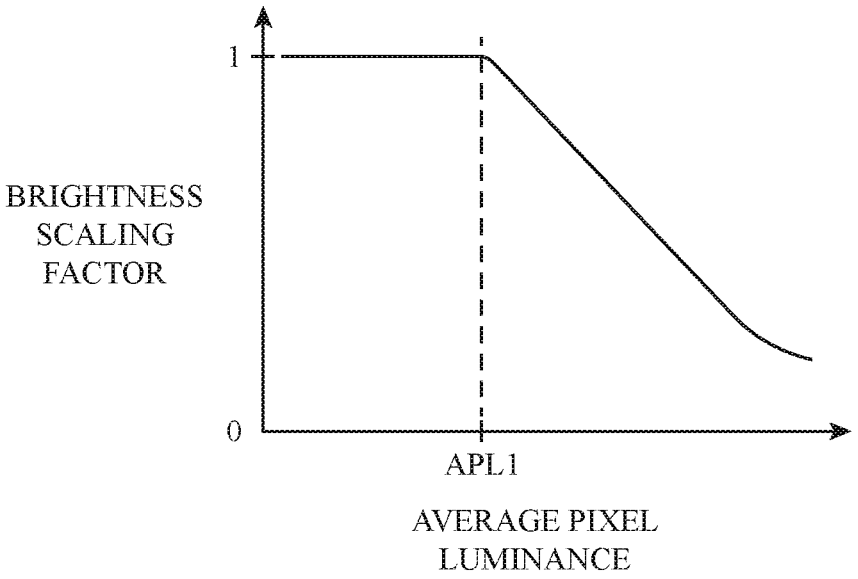
FIG. 5 is a graph showing how a brightness scaling factor may decrease only when average pixel luminance levels exceed a threshold in accordance with an embodiment.

FIG. 5 is a graph showing another illustrative example of how a peak brightness setting may be dynamically adjusted based on average pixel luminance levels. In the example of FIG. 5, control circuitry 12 may only scale down the peak brightness of display 14 for average pixel luminance values that exceed a given threshold. For example, control circuitry 12 may apply a peak brightness scaling factor of 1 for average pixel luminance values between 0 and APL1 (e.g., the peak brightness of display 14 may be equal to the maximum brightness of which display 14 is capable or other default brightness). For average pixel luminance levels greater than APL1, control circuitry 12 may apply a brightness scaling factor between 0 and 1 to thereby scale down the peak brightness of display 14 according to the average pixel luminance level. The curves of FIGS. 4 and 5 are merely illustrative, however. If desired, other curves for mapping average pixel luminance values to a brightness scaling factor may be used.

If desired, engine 24 may apply a content-dependent brightness scaling factor as shown in FIGS. 4 and 5 only in bright ambient light settings and/or when a user has enabled a dark viewing mode (e.g., when display 14 is set by a user to display light text on dark backgrounds). For example, engine 24 may use the mapping curve of FIG. 4 to determine a peak brightness setting for display 14 based on average pixel luminance only when ambient brightness levels exceed a given threshold (e.g., 5,000 nits or other suitable threshold). In other arrangements, engine 24 may determine a peak brightness setting based on average pixel luminance regardless of the ambient light level.

Figure 6:
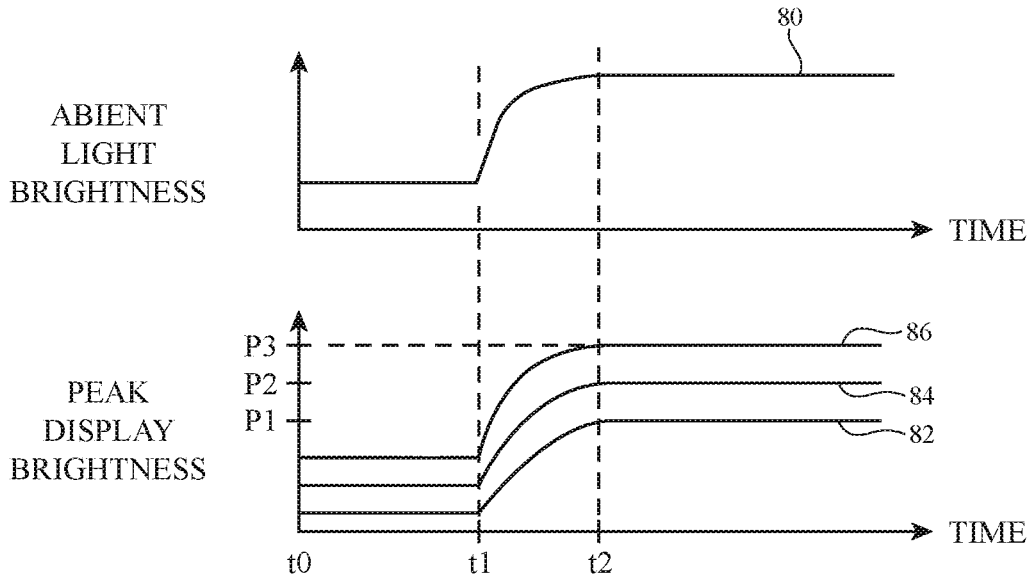
FIG. 6 is a graph showing how a peak display brightness may be adjusted based on ambient light brightness and average pixel luminance levels associated with image content in accordance with an embodiment.

FIG. 6 is a graph showing how the peak display brightness may be adjusted based on both ambient light and average pixel luminance level. Curve 80 of FIG. 6 is an illustrative example of how ambient light brightness may change over time. Curves 82, 84, and 86 show different ways in which the peak display brightness may be adjusted as ambient light brightness changes over time. Curve 82 shows how peak display brightness may be adjusted when average pixel luminance levels are high, curve 84 shows how peak display brightness may be adjusted when average pixel luminance levels are moderate, and curve 86 shows how peak display brightness may be adjusted when average pixel luminance levels are low.

As shown in FIG. 6, curves 82, 84, and 86 generally track ambient light brightness changes. When ambient light brightness is static between time t0 and time t1, peak display brightness may also remain static. When ambient light brightness increases from time t1 to time t2, the peak display brightness may also increase to improve readability of display 14. When ambient light is static at time t2, the peak brightness of display 14 may also remain static.

From time t2 onward, display 14 may be located in a bright outdoor environment. Thus, to ensure that display 14 maintains good readability, the peak brightness of display 14 may be increased accordingly, as shown by curves 82, 84, and 86. Depending on the content being displayed, display 14 may reach different peak brightness levels in bright outdoor light. For example, the peak allowable brightness in bright ambient light after time t2 may be based on average pixel luminance levels (e.g., as discussed in connection with FIGS. 4 and 5) and/or may be based on other information about the content on display 14 (e.g., which application is displaying content on display 14, whether the content on display 14 is mostly color content, mostly black and white content, mostly dark content, mostly light content, etc.).

When the content on display 14 is mostly dark content (e.g., when average pixel luminance levels are low), display 14 may follow curve 86 and may take advantage of the maximum brightness of which display 14 is capable in outdoor environments without compromising battery life. As shown in FIG. 6, curve 86 reaches peak brightness level P3 at time t2, which may be equal to the peak achievable brightness of display 14 or the default brightness of display 14.

When the content on display 14 is a mix of dark and light content (e.g., when average pixel luminance levels are moderate), display 14 may follow curve 84 and may scale down the maximum brightness of which display 14 is capable in outdoor environments to help extend battery life. As shown in FIG. 6, curve 84 reaches peak brightness level P2 at time t2, which may be less than the maximum brightness of which display 14 is capable and/or less than the default maximum brightness of display 14. For example, peak brightness P2 may be determined by multiplying the maximum achievable brightness of display 14 and/or the default maximum brightness of display 14 by a brightness scaling factor (e.g., a factor between 0 and 1).

When the content on display 14 is mostly light content (e.g., when average pixel luminance levels are high), display 14 may follow curve 82 and may scale down the maximum brightness of which display 14 is capable in outdoor environments to help extend battery life. As shown in FIG. 6, curve 82 reaches peak brightness level P1 at time t2, which may be less than the maximum brightness of which display 14 is capable and/or less than the default maximum brightness of display 14. For example, peak brightness P1 may be determined by multiplying the maximum achievable brightness of display 14 and/or the default maximum brightness of display 14 by a brightness scaling factor (e.g., a factor between 0 and 1).

If desired, the control circuitry may only impose this type of content-dependent peak brightness adjustment when the user has enabled such a feature (e.g., when the user has enabled a dark viewing mode in which images are inverted or partially inverted so that the images are mostly dark content). The user may enable content-dependent peak brightness adjustment and/or a dark viewing mode by adjusting a touch screen display switch (e.g., an on-screen switch displayed on display 14), by providing other touch input and/or force input to display 14, or using a button or other input-output device in circuitry 16.

Figure 7:
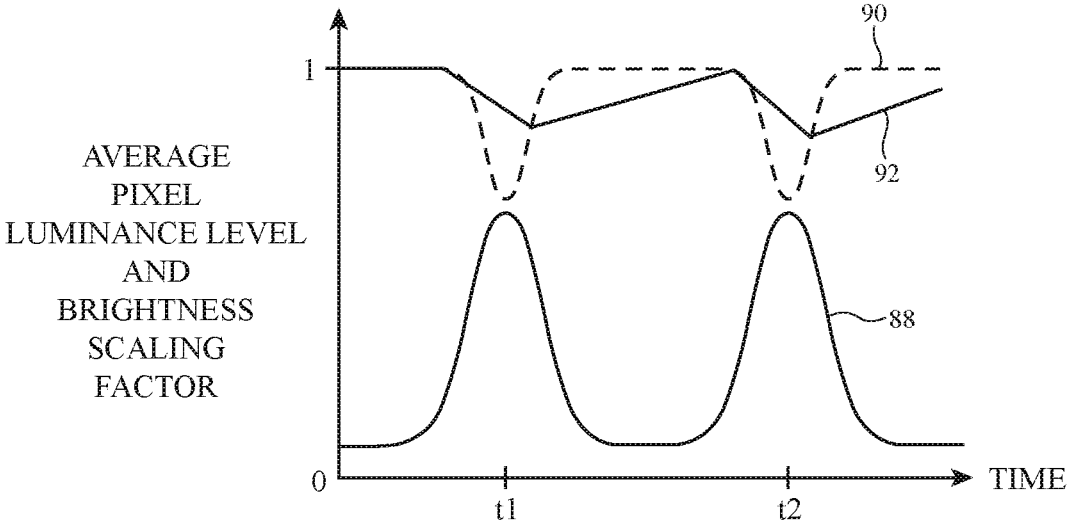
FIG. 7 is a graph showing how a temporal filter may be applied to smooth the transition between peak brightness settings in accordance with an embodiment.

FIG. 7 is a graph showing how a temporal filter may be applied to smooth the brightness transition as the peak brightness is adjusted based on image content (e.g., based on average pixel luminance levels). The x-axis of FIG. 7 corresponds to time and the y-axis of FIG. 7 corresponds to both average pixel luminance level (measured on a scale of 0 to 1, with 0 being a full black image and 1 being a full white image) and a corresponding brightness scaling factor (also ranging from 0 to 1), which is calculated based on the average pixel luminance level.

Curve 88 of FIG. 7 shows how average pixel luminance may change over time. Curve 90 shows how the brightness scaling factor, which is determined based on average pixel luminance, may change over time. Curve 92 shows how the filtered brightness scaling factor may change over time. As shown in FIG. 7, average pixel luminance levels may reach peaks at times t1 and time t2. To accommodate the increased average pixel luminance levels and times t1 and t2, the brightness scaling factor may decrease at times t1 and time t2 to scale down the maximum allowable brightness of display 14. However, without a temporal filter, the brightness shifts at times t1 and time t2 may be noticeable and unpleasant to the viewer. As shown by curve 92, applying a temporal filter to the brightness scaling factor (e.g., curve 90) may help smooth the transition between peak brightness settings. The filter applied may be a low-pass filter that removes a high-frequency component of the brightness scaling factor. This is, however, merely illustrative. If desired, the raw brightness scaling factor may be applied without applying a temporal filter.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

an ambient light sensor that measures an ambient light brightness;

a display that displays images having an associated pixel luminance level; and control circuitry that:

determines whether the ambient light brightness exceeds a first threshold;

determines whether the pixel luminance level exceeds a second threshold; and reduces a maximum allowable brightness of the display in response to determining that the ambient light brightness exceeds the first threshold and that the pixel luminance level exceeds the second threshold.

2. The electronic device defined in claim 1 wherein the control circuitry reduces the maximum allowable brightness of the display by applying a brightness scaling factor to a maximum achievable brightness of the display.

3. The electronic device defined in claim 1 wherein the control circuitry applies a temporal filter to the brightness scaling factor before applying the brightness scaling factor.

4. The electronic device defined in claim 1 wherein the pixel luminance level comprises an average pixel luminance level and wherein the control circuitry reduces the maximum allowable brightness of the display to a scaled peak brightness value that is determined based on the average pixel luminance level.

5. The electronic device defined in claim 1 wherein the control circuitry sets the maximum allowable brightness of the display equal to a maximum achievable brightness of the display in response to determining that the ambient light brightness exceeds the first threshold and that the pixel luminance level is less than the second threshold.

6. An electronic device, comprising:

an ambient light sensor that measures an ambient light brightness;

a display that displays image content having an associated pixel luminance level; and control circuitry that adjusts a maximum allowable brightness of the display based at least partly on the ambient light brightness and the image content, wherein the control circuitry increases the maximum allowable brightness when the ambient light brightness exceeds a first threshold and the pixel luminance level is less than a second threshold.

7. The electronic device defined in claim 6 wherein the control circuitry adjusts the maximum allowable brightness of the display based at least partly on the pixel luminance level associated with the image content.

8. The electronic device defined in claim 7 wherein the control circuitry reduces the maximum allowable brightness when the ambient light brightness exceeds the first threshold and the pixel luminance level exceeds the second threshold.

9. The electronic device defined in claim 8 wherein the pixel luminance level comprises a pixel luminance level selected from the group consisting of: an average pixel luminance level and a median pixel luminance level.

10. The electronic device defined in claim 7 wherein the maximum allowable brightness is equal to a brightness scaling factor multiplied by a maximum achievable brightness of the display.

11. The electronic device defined in claim 10 wherein the control circuitry determines the brightness scaling factor based on the pixel luminance level.

12. The electronic device defined in claim 11 wherein the control circuitry applies a temporal filter to the brightness scaling factor before multiplying the brightness scaling factor by the maximum achievable brightness.

13. The electronic device defined in claim 12 wherein the temporal filter comprises a low-pass filter.

14. The electronic device defined in claim 13 wherein the brightness scaling factor comprises a number between 0 and 1.

15. An electronic device, comprising:

a display that displays image content; and control circuitry that:

analyzes the image content to determine whether the image content is mostly dark image content or mostly light image content;

selects a first peak allowable brightness for the display when the image content is mostly dark image content; and selects a second peak allowable brightness for the display when the image content is mostly light image content, wherein the second peak allowable brightness is lower than the first peak allowable brightness.

16. The electronic device defined in claim 15 wherein the image content has an associated pixel luminance level and wherein the control circuitry determines whether the image content is mostly dark image content or mostly light image content by determining whether the pixel luminance level exceeds a threshold.

17. The electronic device defined in claim 15 wherein the first peak allowable brightness is equal to a maximum achievable brightness of the display.

18. The electronic device defined in claim 15 wherein the first peak allowable brightness is associated with a first content-luminance-to-display-luminance mapping curve and wherein the second peak allowable brightness is associated with a second content-luminance-to-display-luminance mapping curve that is different from the first content-luminance-to-display-luminance mapping curve.

19. The electronic device defined in claim 15 wherein the control circuitry applies a low-pass temporal filter when the control circuitry shifts between the first peak allowable brightness and the second peak allowable brightness.

* * * * *